US006903520B2

(12) United States Patent
Taniwa et al.

(10) Patent No.: US 6,903,520 B2
(45) Date of Patent: Jun. 7, 2005

(54) DEFLECTION YORK AND CRT DEVICE USING THE DEFLECTION YORK

(75) Inventors: Kenichiro Taniwa, Takatsuki (JP); Koji Shimada, Kusatsu (JP); Shunsuke Matsuura, Takatsuki (JP)

(73) Assignee: Matsushita Electric Industrial Co., Ltd., Osaka-Fu (JP)

( * ) Notice: Subject to any disclaimer, the term of this patent is extended or adjusted under 35 U.S.C. 154(b) by 0 days.

(21) Appl. No.: 10/207,941

(22) Filed: Jul. 29, 2002

(65) Prior Publication Data

US 2003/0025468 A1 Feb. 6, 2003

(30) Foreign Application Priority Data

Aug. 1, 2001 (JP) ..... 2001-233240

(51) Int. Cl.[7] ..... G09G 1/28
(52) U.S. Cl. ..... 315/386; 315/368.25
(58) Field of Search ..... 315/386, 370, 315/371, 400, 391, 368.11, 368.25, 368.28; 313/440, 477 R, 442; 335/212, 210, 213, 211, 214

(56) References Cited

U.S. PATENT DOCUMENTS 2,824,267 A 2/1958 Barkow ..... 317/200
5,977,700 A * 11/1999 Lee ..... 313/440
6,087,767 A 7/2000 Sano et al. ..... 313/440
6,559,588 B1 * 5/2003 Choi ..... 313/440
6,686,709 B2 * 2/2004 Lee et al. ..... 315/370

FOREIGN PATENT DOCUMENTS

| | | |
|---|---|---|
| EP | 0 809 273 | 11/1997 |
| EP | 1 102 301 | 5/2001 |
| JP | 08007781 | 1/1996 |
| JP | 11-16517 | 1/1999 |

OTHER PUBLICATIONS

Test Model Editing Committee, International Organisation for Standardisation, ISO–IEC/JTC1/SCS9/WG11, Coded Representation of Picture and Audio Information, Document AVC–491, Versions1, Apr. 1993.

* cited by examiner

*Primary Examiner*—James Vannucci

(57) ABSTRACT

Disclosed is a deflection yoke mounted around a glass bulb of a CRT so as to cover a predetermined area of the glass bulb. The predetermined area is where an outer shape of the glass bulb smoothly goes from circular to substantially rectangular along a tube axis of the CRT. The deflection yoke includes a horizontal deflection coil disposed in a shape to fit with the outer shape of the glass bulb, and a funnel-shaped ferrite core disposed to surround the horizontal deflection coil. The inner shape of the ferrite core is circular throughout a length of the ferrite core.

16 Claims, 13 Drawing Sheets

FIG.6

| | Deflection Yoke 104 | Deflection Yoke 24 | Unit |
|---|---|---|---|
| LH | 97.7 | 94.3 | $\mu$H |
| LV | 5.14 | 4.69 | mH |
| RH | 0.23 | 0.23 | Ω |
| RV | 6.9 | 6.9 | Ω |
| IH | 12.6 | 12.8 | A |
| IV | 1.92 | 1.94 | A |
| PH | 15.5 | 15.5 | $mHA^2$ |
| PV | 25.5 | 26 | $\Omega A^2$ |

FIG.11

Deflection Yoke of Present Embodiment

| | | Section on B-B | Section on C-C | Section on D-D |
|---|---|---|---|---|
| Ferrite Core | Internal Size along X Axis (mm) | 36.0 | 68.0 | 85.5 |
| | Internal Size along Y Axis (mm) | 36.0 | 68.0 | 85.5 |
| | Internal Diagonal Size (mm) | 36.0 | 68.0 | 85.5 |
| Separator | Internal Size along X Axis (mm) | 46.4 | 55.7 | 69.4 |
| | Internal Size along Y Axis (mm) | 46.4 | 44.8 | 55.1 |
| | Internal Diagonal Size (mm) | 46.4 | 58.5 | 75.2 |

FIG.12

Deflection Yoke of Prior Art

| | | Section on K-K | Section on L-L | Section on M-M |
|---|---|---|---|---|
| Ferrite Core | Internal Size along X Axis (mm) | 36.0 | 60.8 | 75.7 |
| | Internal Size along Y Axis (mm) | 36.0 | 55.1 | 65.4 |
| | Internal Diagonal Size (mm) | 36.0 | 68.0 | 85.5 |
| Separator | Internal Size along X Axis (mm) | 46.4 | 55.7 | 69.4 |
| | Internal Size along Y Axis (mm) | 46.4 | 44.8 | 55.1 |
| | Internal Diagonal Size (mm) | 46.4 | 58.5 | 75.2 |

DEFLECTION YORK AND CRT DEVICE USING THE DEFLECTION YORK

BACKGROUND OF THE INVENTION

1. Field of the Invention

The present invention relates to a deflection yoke and a cathode ray tube (CRT) device using the deflection yoke.

2. Description of the Related Art

In recent years, energy-conservation measures are being taken in various fields and industries to prevent environmental destruction. The filed of CRT devices is no exception, and various attempts have been made to reduce power requirements of CRTs.

One attempt to reduce power consumption is to change the shape of deflection yokes.

FIGS. 1A, 1B, 1C, and 1D show, as one example, a color CRT device 100 resulted from such an attempt. The CRT device 100 has a 4:3 aspect ratio, a deflection angle of 100°, and a diagonal size of 19 inches.

FIG. 1A is a schematic side view showing the color CRT device 100.

The color CRT device 100 is composed of a CRT 102 and a deflection yoke 104.

The CRT 102 includes a glass bulb 112 composed of: a glass panel 106 having a rectangular front face; a glass funnel 108; and a cylindrical glass neck 110 that are joined together in the stated order. Formed inside the panel 106 is a phosphor screen (not illustrated), and installed inside the neck 110 is an in-line type electron gun (not illustrated). The in-line type electron gun is composed of three electron guns respectively corresponding to B (blue), G (green), and R (red) arranged in a horizontal direction (X axis direction) in the stated order when seen from the side of the panel 106.

The deflection yoke 104 is mounted along the outer surface of the glass bulb 112 in a manner to cover the boundary between the neck 110 and the funnel 108. That is, the deflection yoke 104 is mounted on the glass bulb 112 to cover a particular part. At the particular part, the outer surface of the glass bulb 112 has such a shape that cross sections taken along lines perpendicular to the tube axis (Z axis) of the CRT gradually change from circular to substantially rectangular as the section lines shift closer from the neck 110 to the panel 106. In this specification, the ouster surface of the glass bulb where the deflection yoke is mounted is referred to as a "yoke-mounting part".

In the color CRT device 100, the in-line type electron gun emits electron beams along the tube axis (Z axis) direction of the CRT 102. The electron beams are then deflected by the action of deflection magnetic field that is generated inside the deflection yoke 104 so as to accomplish scanning over the phosphor screen provided inside the panel 106.

FIGS. 1B, 1C, and 1D are sectional views showing the deflection yoke 104 taken along the lines K—K, L—L, and M—M in FIG. 1A, respectively. The distances from the front face of the panel to the section lines K—K, L—L, and M—M in the axial direction (Z axis direction) are 56.9 [mm], 31.9 [mm], and 21.9 [mm], respectively.

As shown in FIGS. 1B, 1C, and 1D, the cross sections of the deflection yoke 104, roughly speaking, change from circular to substantially rectangular as the section lines shift closer from the neck 110 to the panel 106, so that the deflection yoke 104 conforms to the outer shape of the yoke-mounting part of the glass bulb 112.

To be more specific, the deflection yoke 104 is composed of: a funnel-shaped plastic separator 114 having a part of which cross section is substantially rectangular conforming to the outer shape of the yoke-mounting part of the glass bulb 112; a horizontal deflection coil 116 deposed along the inner surface of the separator 114; a vertical deflection coil 118 disposed along the outer surface of the separator 114; and a ferrite core 120 disposed externally to the vertical deflection coil 118 and having a part of which cross section is substantially rectangular.

A conventionally common deflection yoke (not illustrated) is normally composed of a substantially conical separator, a horizontal deflection coil disposed along the inner surface of the separator, a vertical deflection coil disposed along the outer surface of the separator, and a substantially conical ferrite core disposed externally to the vertical deflection coil. Due to its shape, such a conventionally common deflection yoke inevitably has gaps of a considerable size formed between the horizontal deflection coil and the outer surface of the glass bulb.

Unlike such a conventionally common deflection yoke, the deflection yoke 104 has the above-described construction. With this construction, it is intended to position the horizontal deflection coil 116 as close as possible to the outer surface of the glass bulb 112, so that the horizontal deflection coil 116 is positioned as close as possible to the path area of electron beams. This arrangement improves deflection efficiency and consequently reduces power consumption. In addition, in the deflection yoke 104, the vertical deflection coil 118 is also positioned closer to the path area of electron beams than in a conventionally common deflection yoke. This arrangement also contributes to power consumption reduction. Yet, the horizontal deflection coil 116 consumes much greater power than vertical deflection coil 118 does. Thus, the advantageous effect of the deflection yoke 104 is achieved primary by the horizontal deflection coil 116 being arranged close to the glass bulb 112.

As described above, though improvement in the shapes of the separator 114 and other components, the deflection yoke 104 has achieved improved deflection efficiency and, as a consequence, lower power consumption.

It should be noted, however, that the color CRT devices 100 composed of the deflection yoke 104 involve a problem that the convergence performance fluctuates to a greater extent than CRT devices composed of such a conventionally common deflection yoke as above.

SUMMARY OF THE INVENTION

A first object of the present invention is to provide a deflection yoke capable of reducing power consumption without sacrifice of convergence performance as much as possible.

A second object of the present invention is to provide a CRT device composed of a deflection yoke achieving the first object.

(1) The first object of the present invention is achieved by a deflection yoke mounted around a glass bulb of a CRT so as to cover a predetermined area of the glass bulb. The predetermined area is where an outer shape of the glass bulb smoothly goes from circular to substantially rectangular along a tube axis of the CRT. The deflection yoke includes a horizontal deflection coil disposed in a shape to fit with the outer shape of the glass bulb, and a funnel-shaped ferrite core disposed to surround the horizontal deflection coil. An inner shape of the ferrite core is circular throughout a length of the ferrite core.

(2) Alternatively, the first object of the present invention is achieved by a deflection yoke mounted around a glass bulb of a CRT so as to cover a predetermined area of the glass bulb. The predetermined area is where an outer shape of the glass bulb smoothly goes from circular to substantially rectangular along a tube axis of the CRT. The deflection yoke includes a horizontal deflection coil disposed in a shape to fit with the outer shape of the glass bulb; and a funnel-shaped ferrite core disposed to surround the horizontal deflection coil. An inner surface of the ferrite core has been ground with a grinding machine.

(3) The second object of the present invention is achieved by a CRT device including a CRT having a glass bulb; and a deflection yoke of (1). The deflection yoke is mounted around the glass bulb so as to cover a predetermined area of the glass bulb. The predetermined area is where an outer shape of the glass bulb smoothly goes from circular to substantially rectangular along a tube axis of the CRT.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIG. 6 is a view showing test results conducted on the deflection yoke according to the embodiment and the deflection yoke according to the prior art to compare respective deflection power;

FIG. 11 is a view showing dimensions of each part of the ferrite core and the separator shown in FIGS. 4B, 4C, and 4D;

FIG. 12 is a view showing dimensions of each part of a ferrite core and a separator shown in FIGS. 1B, 1C, and 1D.

DESCRIPTION OF THE PREFERRED EMBODIMENT

The following describes one preferred embodiment of the present invention with reference to the accompanying drawings.

Figure 2:
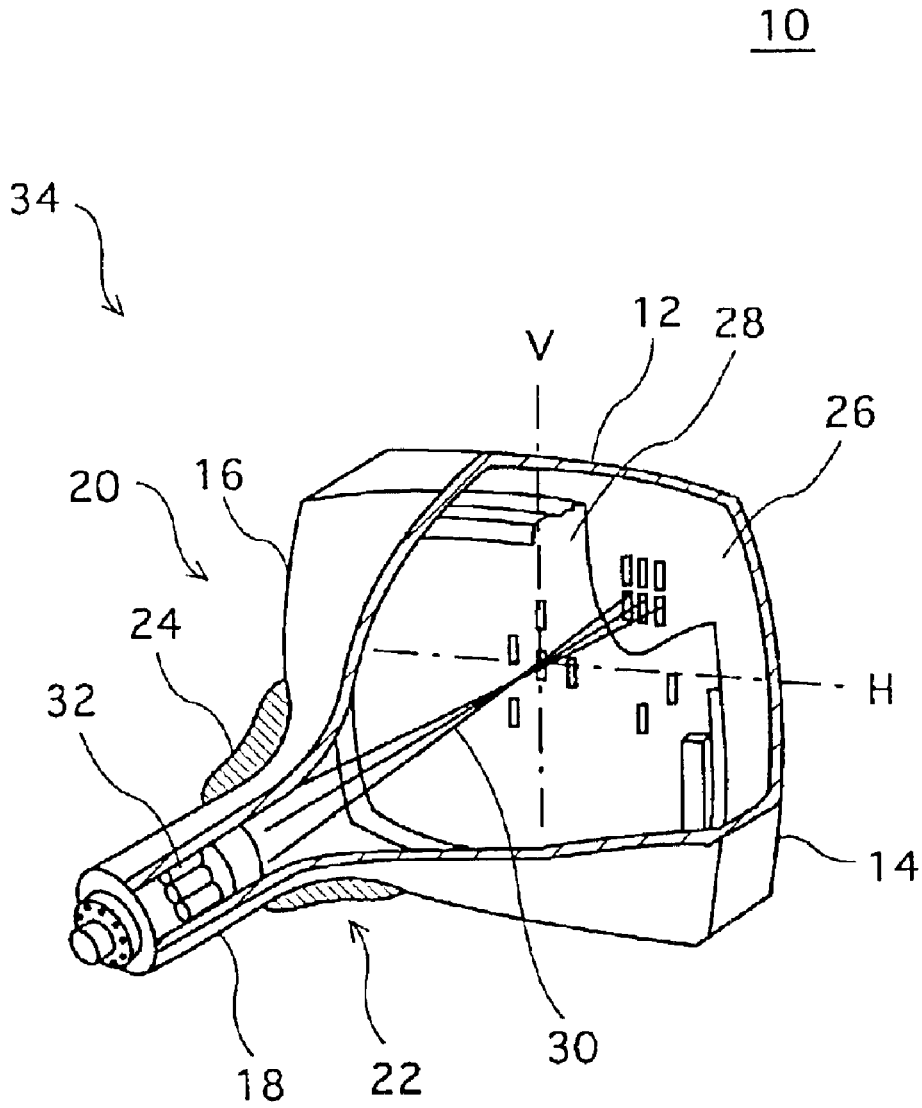
FIG. 2 is a schematic view showing a color CRT device according to an embodiment of the present invention.

FIG. 2 is a schematic view showing a color CRT device 10 according to this embodiment.

The color CRT device 10 has a 4:3 aspect ratio, a deflection angle of 100°, and a diagonal size of 19 inches.

The color CRT device 10 includes a glass bulb 20 that is composed of: a glass panel 14 having a substantially rectangular display 12 at the front; a glass funnel 16 joined to the panel 14; and a cylindrical glass neck 18 joined to the funnel 16. The funnel 16 literally has a funnel shape, and the tube end of the funnel shape is circular conforming to the shape of the neck 18 joined thereto. On the other hand, the flare part of the funnel shape is substantially in a shape of pyramid.

Mounted around a yoke-mounting part 22 of the glass bulb 20 is a deflection yoke 24. That is, the deflection yoke 24 is disposed around the outer surface of the glass bulb 20 in a manner to cover the boundary between the neck 18 and the funnel 16.

Provided inside the panel 14 is a phosphor screen 26 composed of a three-color phosphor layer that is composed of phosphors each emitting blue, green, or red light and are arranged in dots or stripes. Opposing to and inside the phosphor screen 26, there is provided a shadow mask 28 having a plurality of apertures for electron beams to pass through.

Disposed within the neck 18 is an in-line type electron gun 32 that emits three electron beams 30. The in-line type electron gun is composed of three electron guns that correspond to B (blue), G (green), and R (red), respectively and that are horizontally arranged in the stated order from left to right when seen from the panel 14. The electron beams 30 are deflected in the horizontal and vertical directions by virtue of horizontal and vertical deflection magnetic fields that are generated by the deflection yoke 24, and pass through the apertures of the shadow mask 28 to be scanned horizontally and vertically over the phosphor screen 26. As a result, visible color images are produced on the display 12.

Note that the glass bulb 20 that includes the electron gun 32 and the other components described above is hereinafter referred to as a CRT 34. That is, the color CRT device 10 is composed of the CRT 34 and the deflection yoke 24.

Figure 3:
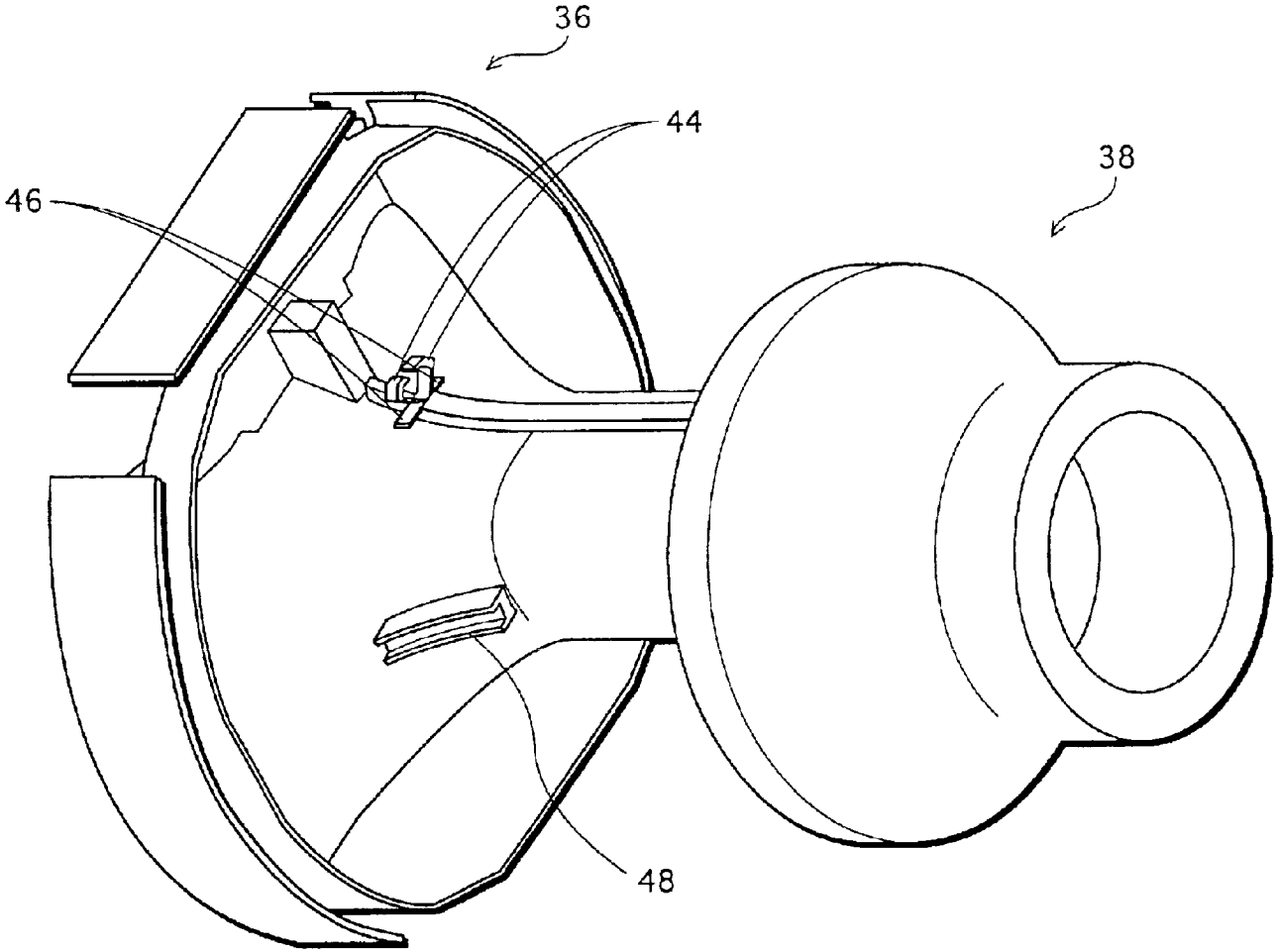
FIG. 3 is an oblique view showing a separator and a ferrite core, which are the components of the deflection yoke according to the embodiment.

FIG. 3 is an oblique view showing components of the deflection yoke 24, namely a separator 36 and a ferrite core 38.

Figure 1A:
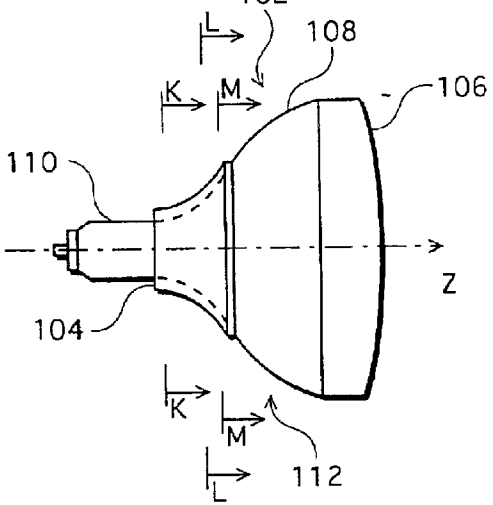
FIG.1A PRIOR ART
FIGS. 1A, 1B, 1C, and 1D are views for illustrating a conventional CRT device and a conventional deflection yoke.
Figure 1B:
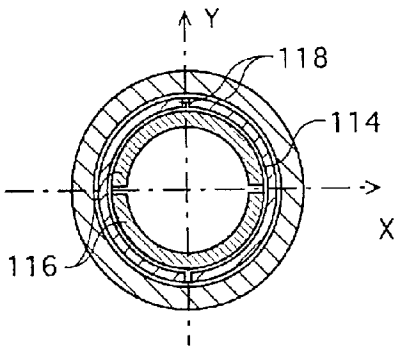
FIG.1B PRIOR ART
Figure 1C:
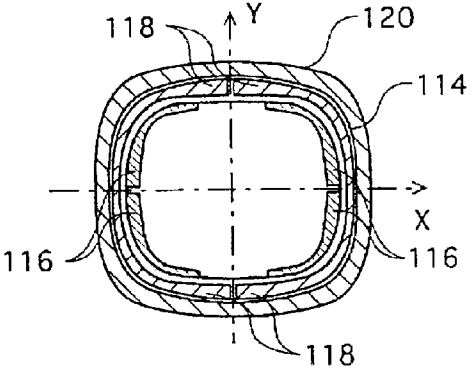
FIG.1C PRIOR ART
Figure 1D:
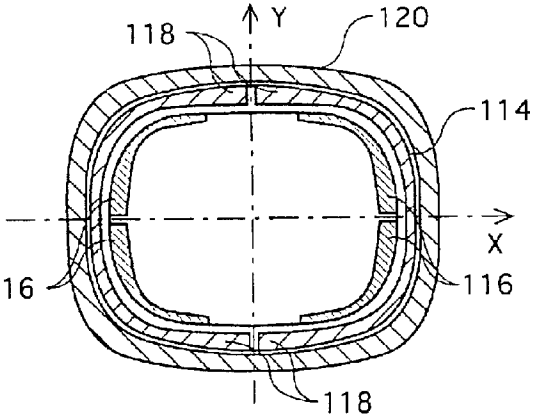
FIG.1D PRIOR ART
Figure 4A:
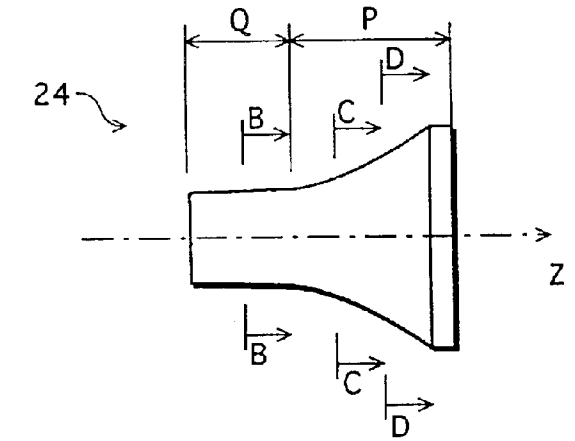
FIG. 4A is a side view showing the deflection yoke according to the embodiment.
Figure 4B:
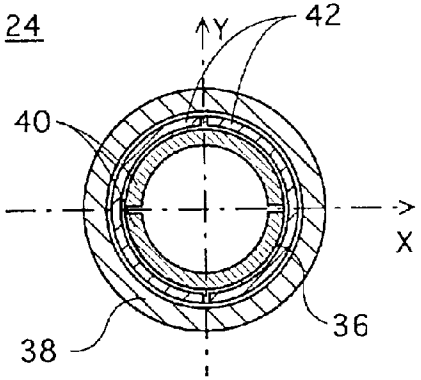
FIGS. 4B, 4C, and 4D are sectional views showing the deflection yoke taken along lines shown in FIG. 4A.
Figure 4C:
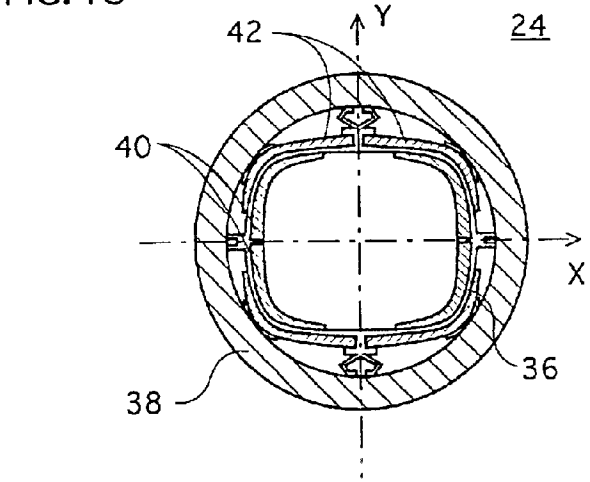
Figure 4D:
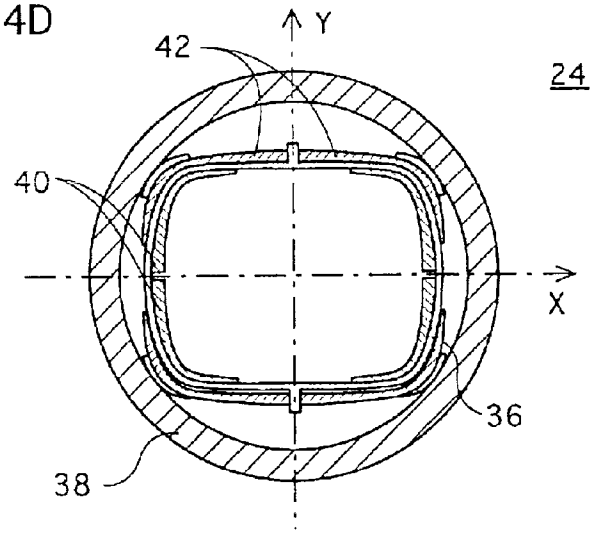

FIG. 4A is a side view of the deflection yoke 24. FIGS. 4B–4D are sectional views showing the deflection yoke 24 taken along the lines B—B, C—C, and D—D shown in FIG. 4A, respectively. Similarly to the deflection yoke 104 shown in FIGS. 1B–1D, the distances from the front face of the panel 14 to the section lines B—B, C—C, and D—D in the axial direction (Z axis direction) are 56.9 [mm], 31.9 [mm], and 21.9 [mm], respectively.

As shown in FIGS. 3 and 4B–4D, the shape of the separator 36 gradually changes in cross section from circular at the part closer to the neck 18 of the CRT 34 to substantially rectangular at the part closer to the panel 14. That is, the separator 36 has a funnel shape conforming to the shape of the yoke-mounting part 22 of the glass bulb 20. On the other hand, the ferrite core 38 is always circular in cross section taking along any of the section lines. Yet, the diameter of the circular cross section is smaller as the section line is closer to the neck 18. As shown in FIG. 4A, the part P where the separator 36 is non-circular in the inner periphery of the cross section is referred to as a non-circular part, while the part Q where the separator 36 is circular in the inner periphery of the cross section is referred to as a circular part.

Figure 5:
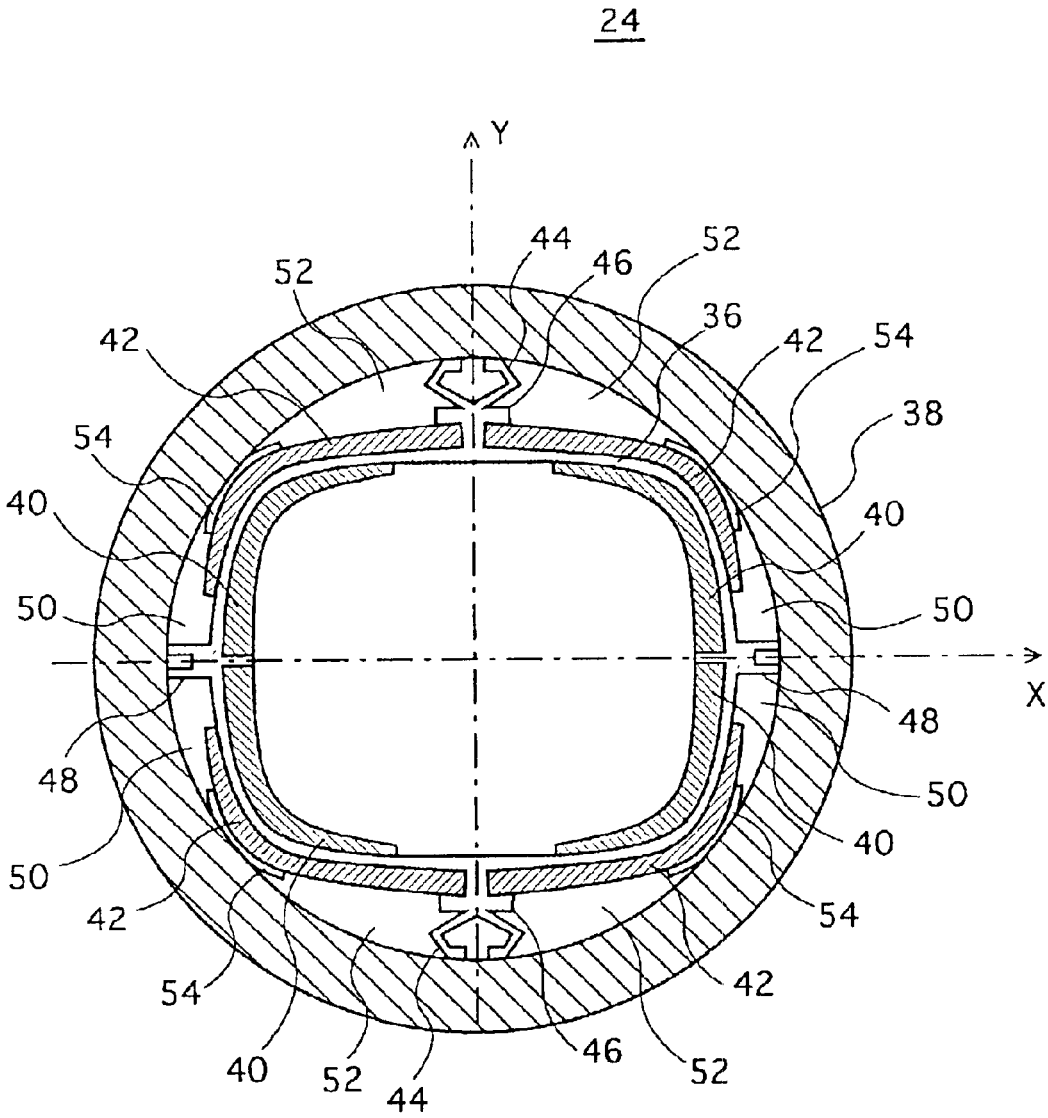
FIG. 5 is an enlarged view of FIG. 4C.

Next, the construction of the deflection yoke 24 is described in detail with reference additionally to FIG. 5. FIG. 5 is an enlarged view of FIG. 4C.

As shown in FIG. 5, the separator 36 having the non-circular part is an insulating frame that insulates a horizontal deflection coil 40 and a vertical deflection coil 42. The separator 36 is made of a plastic material (electric non-conductance resin).

The horizontal deflection coil 40 is composed of a pair of coil segments that are wound into a so-called saddle-shape and that are arranged inside the separator 36 symmetrically to the X axis (major axis) of the separator. The horizontal deflection coil 40 is disposed along the inner surface of the separator 36. That is, when the deflection yoke 24 is mounted to the glass bulb 20, the horizontal deflection coil 40 is located along the outer surface of the glass bulb 20 at the yoke-mounting part 22.

Similarly, the vertical deflection coil 42 is composed of a pair of coil segments that are wound into a saddle-shape and that are arranged outside the separator 36 symmetrically to the Y axis (minor axis) of the separator. From a macroscopic viewpoint, the horizontal deflection coil 40 and the vertical deflection coil 42 substantially define a rectangle in cross section so that both the coils conform to the shape of the separator 36.

Additionally, the ferrite core 38 is mounted in a manner to cover the separator 36, the horizontal deflection coil 40, and the vertical deflection coil 42. The ferrite core 38 has a funnel shape, and is circular in cross section.

As described above, the deflection yoke 24 according to the embodiment of the present invention has the non-circular part P (see FIG. 4A) where the separator 36, the horizontal deflection coil 40, and the vertical deflection coil 42 are non-circular in cross section, thereby conforming to the shape of the yoke-mounting part 22 of the glass bulb 20. In the non-circular part P, the horizontal deflection coil 40 and the vertical deflection coil 42 (especially the horizontal deflection coil 40) are closer to the path area of the electron beams 30 in comparison with a conventionally common deflection yoke composed of a substantially conical separator and a substantially conical ferrite core. As a consequence, power required to deflect the electron beams 30 (i.e., deflection power) is reduced.

Note that the deflection yoke 24 according to the embodiment of the present invention has the construction that, in the non-circular part P, the ferrite core 38 is farther away from the path area of the electron beams 30 in comparison with the deflection yoke 104 described with reference to FIGS. 1A–1D. For this reason, there was a concern that the deflection yoke 24 would require greater deflection power than the deflection yoke 104 did. However, computer simulations performed by the inventors of the present invention has made it clear, although the details of the simulations are omitted here, that the important factor to reduce deflection power lies not in the ferrite core but in the horizontal deflection coil and the vertical deflection coil (especially, the horizontal deflection coil). Thus, similarly to the deflection yoke 104, the deflection yoke 24 according to this embodiment of the present invention sufficiently realizes the effect to reduce deflection power.

To confirm the above effect, tests were actually conducted and the results are shown in FIG. 6.

The tests were conducted on the deflection yoke 24 according to the embodiment of the present invention and the deflection yoke 104 according to the prior art. In the tests, the electron beams 30 were deflected to a corner of the respective display and various measurements were made, and deflection power of each deflection yoke was calculated from the respective measurements.

In FIG. 6, LH is an inductance of the horizontal deflection coil, LV is an inductance of the vertical deflection coil, RH is a resistance of the horizontal deflection coil, RV is a resistance of the vertical deflection coil, IH is a current passing through the horizontal deflection coil, and IV is a current passing through the vertical deflection coil. Note that all these values are actually measured values.

In addition, PH is a deflection power required by the horizontal deflection coil, and PV is a deflection power required by the vertical deflection coil. Note that values of PH and PV are calculated from the following expressions.

$$PH=LH\times IH^2$$

$$PV=RV\times IV^2$$

As apparent from the test results shown in FIG. 6, there was no difference in PH between the deflection yoke 24 according to the present embodiment and the deflection yoke 104 according to the prior art. In addition, with respect of PV, the deflection yoke 24 was greater only slightly than the deflection yoke 104 by 0.5 [$\Omega A^2$], and thus there was no substantial difference. The test results support that an important factor determining the deflection power lies not in the ferrite core but in the horizontal deflection coil and the vertical deflection coil.

Further, the inventors of the present invention conducted tests to confirm that the deflection yoke 24 according to the present embodiment is better than the deflection yoke 104 in the convergence performance. (Note that hereinafter the deflection yoke 24 is also referred to as a "rectangular coil-circular core type deflection yoke", and the deflection yoke 104 is also referred to as a "rectangular coil-rectangular core type deflection yoke.")

The inventors of the present invention conducted measurements on the rectangular coil-circular core type deflection yoke 24 and the rectangular coil-rectangular core type deflection yoke 104 under the standard of EIAJ (Electronic Industries Association of Japan) to obtain "Xh" and "Xhs", the indices showing the state of convergence. The measurements were also conducted on the conventionally common deflection yoke mentioned in the "Description of the Related Art", i.e. a deflection yoke composed of a substantially conical separator, a horizontal deflection coil mounted along the inner surface of the separator, a vertical deflection coil mounted along the outer surface of the separator, and a substantially conical ferrite core disposed externally to the vertical deflection coil (hereinafter such a conventionally common deflection yoke is also referred to as "circular coil-circular core type deflection yoke).

Ten deflection yokes were manufactured for each of the three types, and measurements were preformed on each deflection yoke to obtain "Xh" and "Xhs". Then, a standard deviation a for each type of the deflection yokes was calculated from the respective measurement values. The variations in the convergence performance were evaluated using the values obtained by multiplying the above standard deviations $\sigma$ by three. The results are shown in FIG. 7.

Figure 7:
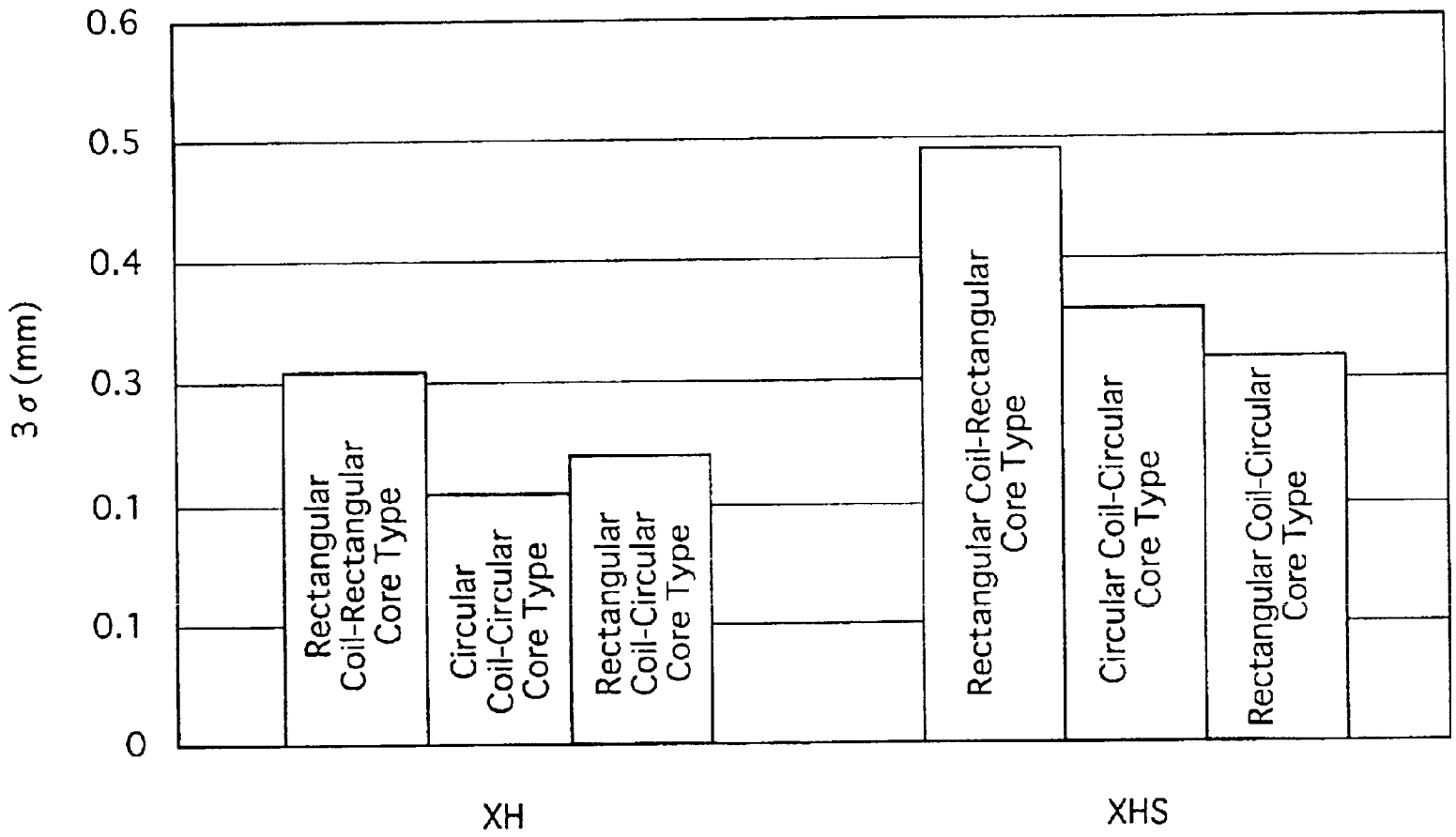
FIG. 7 is a view showing test results conducted on the deflection yoke according to the embodiment and the deflection yoke according to the prior art to compare respective convergence performance.

As apparent from FIG. 7, the rectangular coil-circular core type deflection yokes 24 according to the present embodiment exhibited the convergence performance of which variations (3σ) were smaller than the variations of the rectangular coil-rectangular core type deflection yokes 104, and almost equal to the variations of the circular coil-circular core type deflection yokes.

Factors contributing the above differences in the variations of the convergence performance may be ascribable to degrees of dimensional accuracy of each ferrite core, i.e., dimensional deviation of each ferrite core from the designed dimensions. Generally, ferrite cores are manufactured by press-molding magnetic powder into a metal mold, followed by sintering the press-molded body. At the time of sintering, the press-molded body inevitably undergoes volume contraction, which results in dimensional variations.

Among the dimensional variations, it is assumed that the internal diameter of the ferrite core is especially influential in determining the convergence performance. This is because distribution of magnetic flux that the deflection coil generates varies depending on the internal shape of the ferrite core.

In the case of the substantially conical ferrite core used in the deflection yoke 24 according to the present embodiment, the dimensional accuracy is such that the internal diameter of the ferrite core is held to vary within ±1% from the designed value. In contrast, the substantially pyramid-shaped ferrite core used in the deflection yoke 104 according to the prior art, the dimensional accuracy is such that the internal rectangle varies within ±2.5% in the length of the major side, ±1.6% in the length of the minor side, and ±3.3% in the diagonal length. The difference in the dimensional accuracy among each type of ferrite cores maybe ascribable to the uniformity in the ferrite core thickness and the axial symmetry to the tube axis.

As described above, by improving the dimensional accuracy in the internal dimensions of the ferrite core, the convergence performance is expected to improve.

In view of the above, the deflection yoke 24 according to the present invention having the substantially conical ferrite core 38 has the following advantage over the conventional deflection yoke 104 having the substantially pyramid-shaped ferrite core 120. That is, the substantially conical ferrite core has a smooth internal shape without corners, so that the internal surface may be finished with grinding. On the contrary, such grinding is not possibly applied to the generally pyramid-shaped ferrite core, so that there is no choice but to use the ferrite core as sintered.

In general, metal-molded products are poor in the dimensional accuracy in comparison with ground products. With grinding, the internal diameter of the ferrite core may be held to vary within ±0.2 mm or so regardless of the size of the designed internal diameter. With metal-molding, however, accuracy of the metal molding directly counts for the dimensional accuracy of the finished ferrite core, and thus the internal diameter of such a ferrite core varies from the designed internal diameter to the extent of ±1% or so.

As described above, the greater the dimensional variations of the ferrite cores are, the greater the variations of the convergence performance of the deflection yokes are. This results in degradation of the image quality.

Figure 8A:
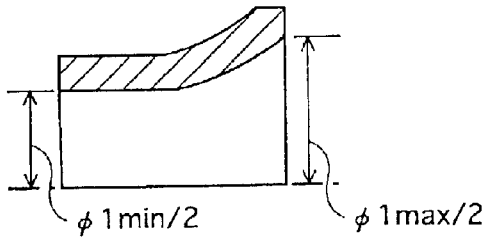
FIG.8A PRIOR ART
FIGS. 8A and 8B are views showing a ferrite core used in the deflection yoke according to the prior art.
Figure 8B:
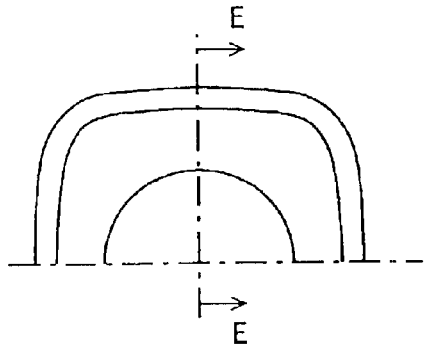
FIG.8B PRIOR ART
Figure 8C:
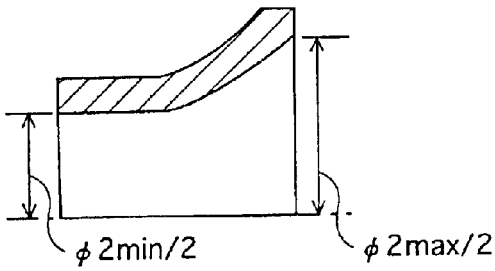
FIGS. 8C and 8D are views showing a ferrite core used in the deflection yoke according to the embodiment.

Now, description is given to the dimensional accuracy of the pyramid-shaped ferrite core and the conical ferrite core with reference to FIGS. 8A–8D. FIG. 8A is a sectional view of a pyramid-shaped ferrite core taken along the line E—E shown in FIG. 8B. FIG. 8C is a sectional view of a conical ferrite core taken along the line F—F shown in FIG. 8D.

Figure 8D:
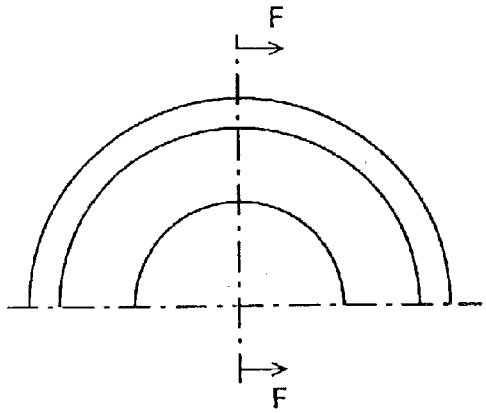

As shown in FIGS. 8A and 8B, when manufacturing by metal molding pyramid-shaped ferrite cores in the designed dimensions: the minimum internal diameter ϕ1 min of which half value is 22.90 mm and the maximum internal diameter ϕ1 max of which half value is 39.75 mm, the finished dimensions vary within the range of 0.79 mm. On the other hand, as shown in FIGS. 8C and 8D, when manufacturing with grinding the conical ferrite cores in the designed dimensions: the minimum internal diameter ϕ2 min of which half value is 23.00 mm and the maximum internal diameter ϕ2 max of which half value is 39.85 mm, the finished dimensions vary within the range of 0.2 mm. In short, the conic ferrite core shown in FIGS. 8C and 8D is better in the dimensional accuracy.

That is to say, a substantially conical ferrite core produced merely by sintering is still capable of improving the convergence performance in comparison with a substantially pyramid-shaped ferrite core. Yet, by grinding the internal surface of the ferrite core, the convergence performance is further improved. The grinding of the internal surface is done using a conventional grinding machine.

Figure 9:
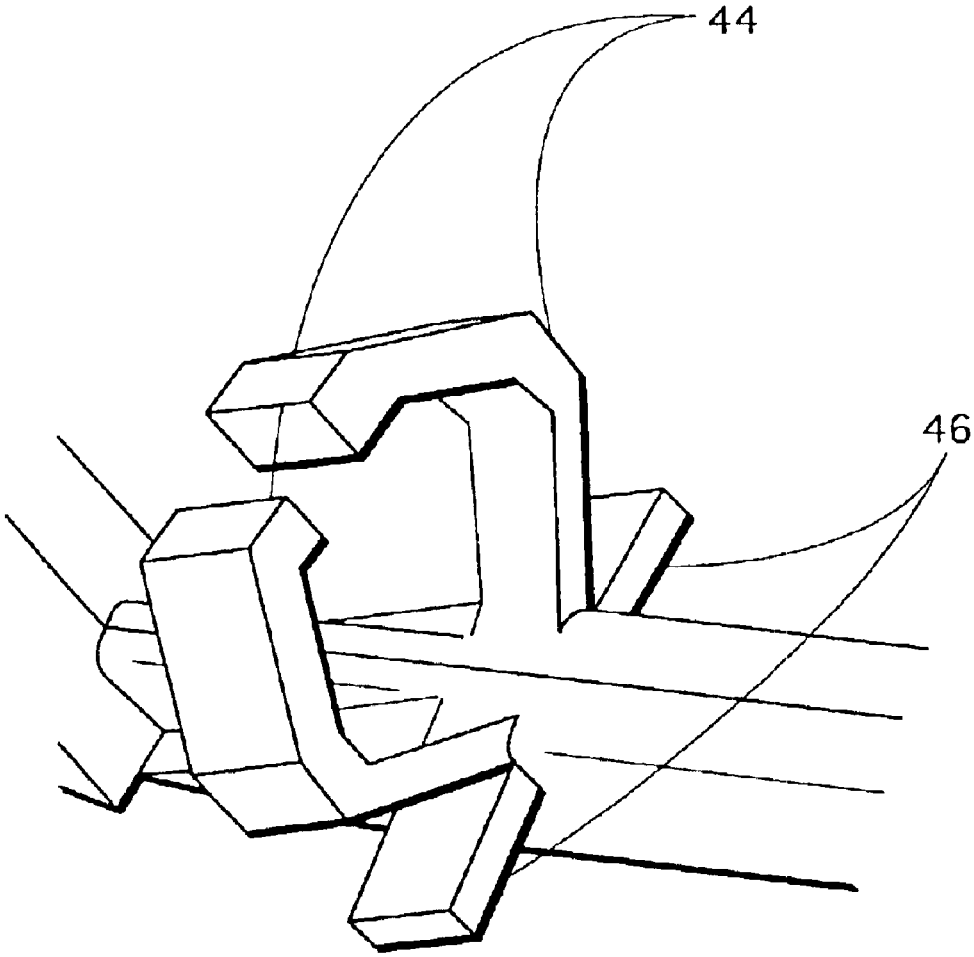
FIG. 9 is partly enlarged view of FIG. 3.

Now, referring back to FIGS. 3 and 5, there are provided resilient mechanisms 44 in the vicinity of a Y axis of the separator 36. FIG. 9 is an enlarged oblique view showing one of the resilient mechanisms 44. The resilient mechanisms 44 resiliently support the ferrite core, and prevent misalignment of the ferrite core 38 that possibly occurs at the time of assembling the deflection yoke 24. Since the misalignment of the ferrite core 38 is prevented, the deflection yoke exhibits stable magnetic field characteristics and convergence performance, whereby enabling to provide a color CRT device having good image quality.

Further, there are provided sandwiching mechanisms 46 in adjacent to each resilient mechanism 44. With the sandwiching mechanisms 46, it is possible to dispose the vertical deflection coil at any intended position. Thus, the deflection yoke exhibits stable magnetic field characteristics and convergence performance. Note that the horizontal deflection coil 40 is disposed along the inner surface of the separator 36.

As shown in FIGS. 3 and 5, in the vicinity of the X axis of the separator 36, there are provided holding mechanisms 48 for holding the ferrite core 38 in place. Note that the holding mechanisms 48 are integrally formed with the separator 36 at the time of molding resin. In order to secure a mold drawing direction, each holding mechanism is in U-shape in cross section with an opening in the mold drawing direction as shown in FIG. 5. Alternatively, however, the holding mechanisms may have the similar shape and function to the resilient mechanisms 44.

In addition, there are provided hollows 50 between the ferrite core 38 and the horizontal deflection coil 40 via the separator 36, and hollows 52 between the ferrite core 38 and the vertical deflection coil 42. As described above, in the deflection yoke 24 according to the embodiment of the present invention, the separator 36, the horizontal deflection coil 40, and the vertical deflection coil 42 are all non-circular in cross sections, while the ferrite core 38 is circular in cross section. With this construction, the deflection yoke 24 of the present invention secures the hollows that the conventional deflection yoke 104 shown in FIGS. 1B–1D does not have.

The hollows 50 and 52 serve to improve cooling effect of the horizontal deflection coil 40 and the vertical deflection coil 42. Thus, the horizontal deflection coil 40 and the vertical deflection coil 42 generate less heat in comparison with conventional deflection coils included in a deflection yoke having no such hollows, thus temperature rise in the entire deflection yoke 24 is suppressed.

For further enhancing cooling effect, the diameter of the ferrite core 38 may be enlarged while the dimensions of the separator 36 are left unchanged, thereby enlarging the hollows 50 and 52. Being larger in diameter, however, the ferrite core 38 exhibits less effect on increasing magnetic flux density, which as a result requiring greater deflection power. In addition, if the diameter of the ferrite core 38 is larger without changing the dimensions of the other components, it is increasingly difficult to securely hold the ferrite core 38. As a consequence, the problem of misalignment is likely to arise. In view of the above, it is preferable to dispose the ferrite core 38 close to the horizontal deflection coil 40 and the vertical deflection coil 42. In other words, it is preferable that the inner diameter of the ferrite core 38 be as small as possible.

For the reasons stated above, it is preferable that the inner diameter of the ferrite core 38 at the non-circular part P be made to generally equal to the diagonal distance of the substantially rectangular cross section of the separator 36, or of the substantial rectangle defined by the horizontal deflection coil 40 and the vertical deflection coil 42. To be more specific, it is preferable that the inner diameter of the ferrite core 38 be made generally equal to the diagonal distance between the outermost corners of the vertical deflection coil 42. The vertical deflection coil 42 is provided with an adhesive member 54 such as an adhesive sheet along each corner of the substantial rectangle, which is in contact with the separator 36, so that the vertical deflection coil 42 is protected and fixed to the separator 36.

Figure 10:
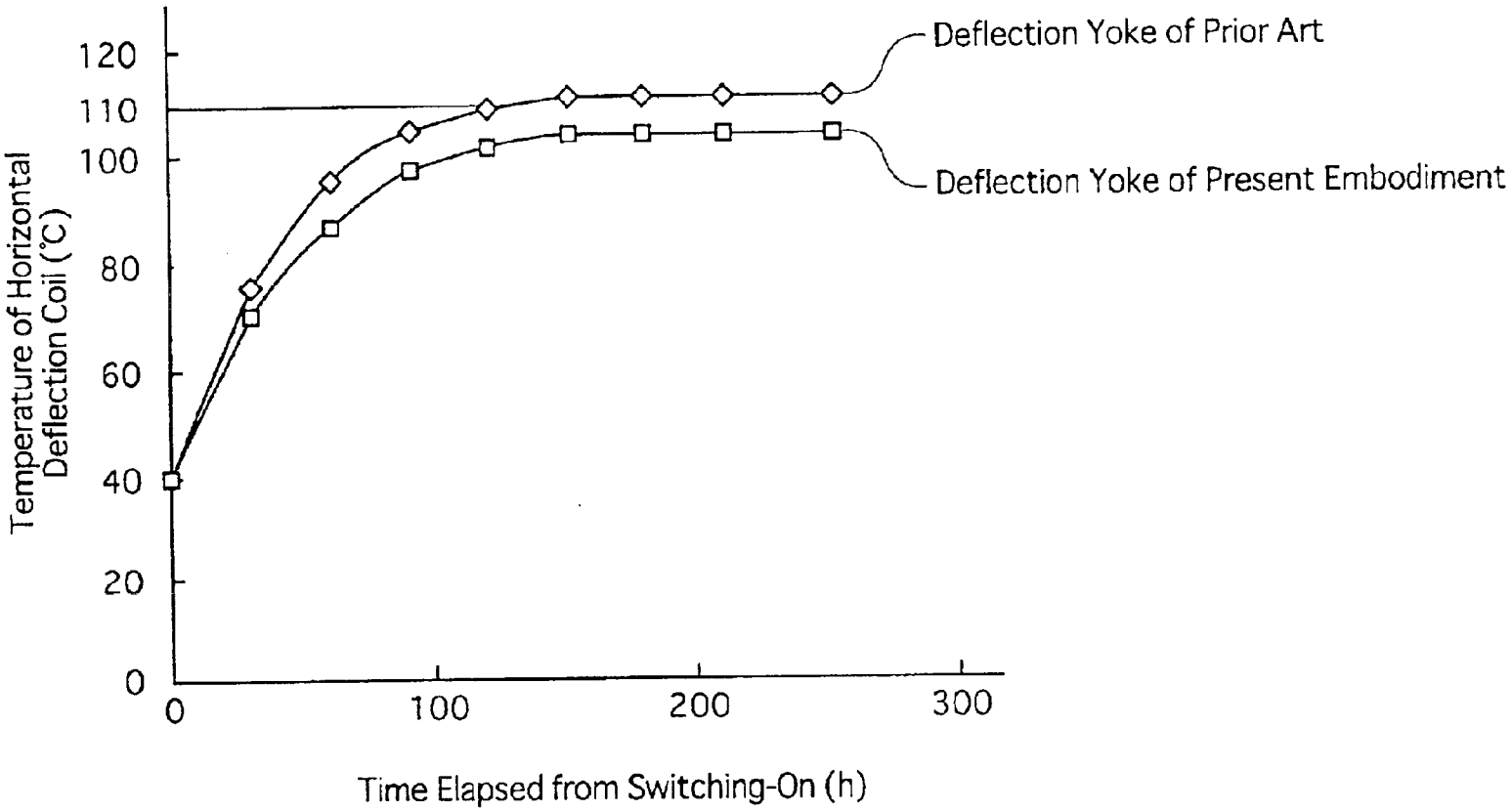
FIG. 10 is a view showing measurement results of tests conducted on the deflection yoke according to the embodiment and the deflection yoke according to the prior art to measure temperature-rise in respective horizontal deflection coils.

Next, with reference to FIG. 10, description is given to the temperature-rise tests conducted on the deflection yoke 24 according to the embodiment of the present invention and on the deflection yoke 104 according to the prior art to measure temperature rise in the respective horizontal deflection yokes. In this test, both the deflection yoke 24 according to the present embodiment and the conventional deflection yoke 104 were deflection yokes (diameter ϕ of the wire forming the horizontal deflection coil: 0.10 mm) for a color CRT (diagonal size: 19 inches, deflection angle: 100°, and neck diameter ϕ: 29.1 mm) to be used as a computer display monitor. Further, the tests were conducted in the environmental temperature of 40° C. and with horizontal deflection frequency of 95 kHz. FIGS. 11 and 12 show the dimensions of each part of respective ferrite cores and separators of the deflection yoke 24 according to the present invention and the deflection yoke 104 according to the prior art, respectively. The dimensions were measured in the cross sections shown in FIGS. 4B–4D and in FIGS. 1B–1D, respectively. The horizontal deflection coil and the vertical deflection coil were disposed along the inner and outer surface of each separator, respectively.

According to the tests, as shown in FIG. 10, the temperature of the horizontal deflection coil in the conventional deflection yoke 104 rose to 110° C., whereas the temperature of the horizontal deflection coil in the deflection yoke 24 of the present embodiment rose only to 103° C. That is to say, the deflection yoke 24 according to the present embodiment successfully reduces the temperature rise of the horizontal deflection coil by 7° C. in comparison with that in the conventional deflection yoke 104. Note that the reason for measuring the temperature of the horizontal deflection coil is because the horizontal deflection coil is where the temperature apt to rise most in the deflection yoke.

Here, the separator of the deflection yoke is made of a plastic material, such as PPE (polyphenylene ether) resin, and the long-term thermal deformation resistance of the resin is guaranteed at temperatures up to 110° C. Thus, there is a risk if the temperature of the horizontal deflection coil reaches 110° C., the separator is thermally deformed so that the insulation between the horizontal deflection coil and the vertical deflection coil may not be maintained. However, with the deflection yoke 24 according to the present invention, the above risk is eliminated, thereby improving thermal reliability of the deflection yoke.

Up to this point, description has been given to the embodiment of the present invention. Yet, it should be understood that the present invention is not limited to the specific embodiment disclosed above, and various modifications as provided below are applicable.

(1) In the above embodiment, the present invention is described by way of the color CRT device. Yet, the present invention may be applied to a monochrome CRT device constituting a projection tube type projector as well as to a deflection yoke used in such a monochrome CRT device.

(2) In the above embodiment, the ferrite core employed is substantially conical having circular cross section.

Alternatively, a ferrite core having a funnel shape with a flare part having elliptic cross section may be applicable. With such a shape having elliptic cross section, the inner surface of the ferrite core maybe ground, thereby assuring dimensional accuracy required for good convergence performance.

In addition, using with a funnel shaped separator having a pyramid-shaped flare part, gaps are provided between the ferrite core that is elliptic in cross section and a vertical deflection coil that is disposed along the outer surface of the separator. The gaps serve to provide cooling effect on the deflection coil similarly to the above embodiment.

Figure 13:
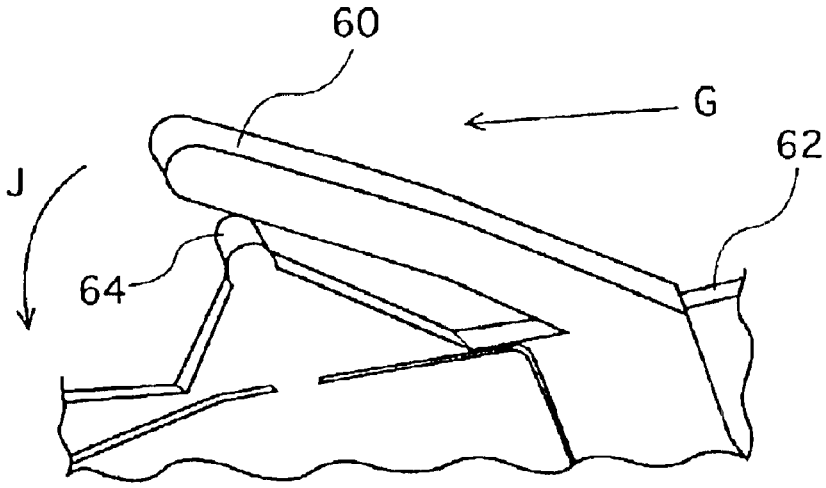
FIG. 13 is a view showing one exemplary modification of a resilient mechanism in the deflection yoke according to the embodiment.

(3) Aside from the resilient mechanisms disclosed in the above embodiment, resilient mechanisms as shown in FIG. 13, for example, may be applicable. FIG. 13 is an enlarged oblique view showing a modified resilient mechanism and in correspondence with FIG. 9. As shown in FIG. 13, there is provided a rib 62 along the outer surface of the separator 36 in the longitudinal direction, and the resilient mechanism is composed of a projection 60 diagonally extending from the top face of the rib 62. The projection 60 is integrally formed with the separator 36 by injection molding. Thus, the projection 60 is made of the same synthetic resin as the material of the separator 36, and has a certain degree of flexibility owing to its shape.

The projections 60 are to be disposed generally at the same locations where the resilient mechanisms 44 are located. That is to say, at least two projections 60 are provided as a pair blow and above the Y axis (see FIG. 5).

Upon assembling the deflection yoke according to this modification, the ferrite core 38 is inserted in the direction shown by an arrow G in FIG. 13. As a consequence, the projection 60 is pressed by the inner surface of the ferrite core 38 to flex in the direction shown by an arrow J. The restoring force produced by the projection 60 resiliently supports the ferrite core 38 from inside against the separator 36.

In addition, a stopper 64 for preventing breakage of the projection 60 is provided in an extended condition from the top face of each rib 62. In case where the ferrite core 38 is inserted in the state somehow deviated in the direction of Y axis, it is inevitable that one of the pair of the projections 60 flexes excessively. The stopper 64 is provided in order to prevent the projection 60 from damage that possibly occurs in such a case. Each stopper 64 is located in the direction that the projection 60 flexes so as to engage against the projection 60 before the projection 60 flexes beyond the flexible limit. As a consequence, the projection 60 does not flex any further. In other words, the stopper 64 restricts the flexible amount of the projection 60 so as to prevent breakage of the projection 60 due to the excessive flexing.

(4) The deflection yoke according to the above preferred embodiment is composed of the saddle-shaped horizontal deflection coil and the saddle-shaped vertical deflection coil that are disposed along the inner surface and the outer surface of the separator, respectively. Yet, a deflection yoke consistent with the present invention is not limited to such a deflection yoke and, for example, the following modification is possible.

That is, the horizontal deflection coil may be a similar one to the above horizontal deflection coil, i.e., a saddle-shaped horizontal deflection coil disposed along the inner surface of the ferrite core. Here, the vertical deflection coil may be a toroidal coil that is wound around the ferrite core.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A deflection yoke mounted around a yoke-mounting part of a glass bulb, the yoke-mounting part being where an outer shape of the glass bulb smoothly goes from circular to substantially rectangular along a tube axis of the glass bulb, the deflection yoke comprising:

a horizontal deflection coil disposed in a shape to resemble the outer shape of the glass bulb and being disposed in close proximity to an outer surface of the glass bulb; and a funnel-shaped ferrite core disposed to surround the horizontal deflection coil, an inner shape of the ferrite core being one of a circular and elliptical shape throughout a length of the ferrite core.

2. The deflection yoke of claim 1, further comprising:

an insulating frame covered with the ferrite core, wherein the horizontal deflection coil is held along an inner surface of the insulating frame so as to be electrically insulated from a vertical deflection coil; and a resilient support member disposed in a gap between the insulating frame and the ferrite core, the resilient support member resiliently supporting the ferrite core against the insulating frame.

3. The deflection yoke of claim 3, wherein the resilient support member is made of a flexible member and supports the ferrite core by a restoring force of the flexible member; and the deflection yoke further includes a protecting member that restricts a flexible amount of the flexible member so as to protect the flexible member from being damaged.

4. The deflection yoke of claim 1, further comprising:

an insulating frame covered with the ferrite core, and holding the horizontal deflection coil along an inner surface of the insulating frame;

a vertical deflection coil disposed in a shape to fit with an outer shape of the insulating frame; and a sandwiching member for partly sandwiching the vertical deflection coil between the sandwiching member and the outer surface of the insulating frame.

5. A CRT device comprising:

a CRT having a glass bulb; and a deflection yoke of claim 1;

wherein the deflection yoke is mounted around a yoke-mounting part of the glass bulb, the yoke-mounting part being where an outer shape of the glass bulb smoothly goes from circular to substantially rectangular along a tube axis of the CRT.

6. The deflection yoke of claim 1, wherein a gap between the horizontal deflection coil and the funnel-shaped ferrite core increases in a portion of the yoke-mounting part when moving towards a screen side of the glass bulb.

7. A device comprising:

a deflection yoke for mounting around a yoke-mounting part of a glass bulb, the yoke-mounting part having a cross section changing from a substantially circular portion to a substantially rectangular portion along a tube axis of the glass bulb, the deflection yoke including:

a deflection coil disposed in a shape to resemble the outer shape of the glass bulb and being disposed in close proximity to an outer surface of the glass bulb; and a ferrite core disposed to surround the deflection coil, an inner shape of the ferrite core being substantially one of a circular and elliptical shape throughout a length of the ferrite core.

8. The device of claim 7 further comprising:

an insulating frame holding a horizontal deflection coil along an inner surface of the insulating frame.

9. The device claim 8 further comprising:

a vertical deflection coil disposed in a shape to fit with an outer shape of the insulating frame.

10. The device of claim 9 further comprising:

a sandwiching member for partly sandwiching the vertical deflection coil between the sandwiching member and the outer surface of the insulating frame.

11. The device of claim 7, wherein a gap between the deflection coil and the ferrite core increases in a portion of the yoke-mounting part when moving towards a screen side of the glass bulb.

12. A CRT device comprising:

a deflection yoke for mounting around a yoke-mounting part of a glass bulb, the yoke-mounting part having a cross section changing from a substantially circular portion to a substantially rectangular portion along a tube axis of the glass bulb, the deflection yoke including:

a deflection coil, a shape of the deflection coil at a screen side being substantially rectangular; and a ferrite core disposed to surround the deflection coil, an inner shape of the ferrite core at the screen side being substantially one of a circular and elliptical shape.

13. The CRT device claim 12, further comprising:

a insulating frame covered with the ferrite core, wherein the horizontal deflection coil is held along an inner surface of the insulating frame so as to be electrically insulated from a vertical deflection coil; and a resilient support member disposed in a gap between the insulating frame and the ferrite core, the resilient support member resiliently supporting the ferrite core against the insulating frame.

14. The CRT device of claim 13, wherein the resilient support member is made of a flexible member and supports the ferrite core by a restoring force of the flexible member; and the deflection yoke further includes a protecting member that restricts a flexible amount of the flexible member so as to protect the flexible member from being damaged.

15. The CRT device claim 12, further comprising:

a insulating frame covered with the ferrite core, and holding the horizontal deflection coil along an inner surface of the insulating frame;

a vertical deflection coil disposed in a shape to fit with an outer shape of the insulating frame; and a sandwiching member for partly sandwiching the vertical deflection coil between the sandwiching member and the outer surface of the insulating frame.

16. The CRT device of claim 12, wherein a gap between the deflection coil and the ferrite core increases in a portion of the yoke-mounting part when moving towards a screen side of the glass bulb.

* * * * *